US005749530A

United States Patent [19]

Nakayama et al.

[11] Patent Number: 5,749,530

[45] Date of Patent: May 12, 1998

[54] METHOD FOR OPERATING AN ECCENTRIC JAW CRUSHER

[75] Inventors: Hiroshi Nakayama, Chiba; Koichiro Ogushi; Tomio Aimori, both of Saga, all of Japan

[73] Assignee: Nakayama Iron Works, Ltd., Saga, Japan

[21] Appl. No.: 746,200

[22] Filed: Nov. 6, 1996

[30] Foreign Application Priority Data

Nov. 10, 1995 [JP] Japan ..... 7-317173

[51] Int. Cl.[6] ..... B02C 1/02

[52] U.S. Cl. ..... 241/27; 241/29; 241/37; 241/264

[58] Field of Search ..... 241/262, 263, 241/264, 267, 268, 269, 27, 37, 29

[56] References Cited

U.S. PATENT DOCUMENTS 5,397,069 3/1995 Kitsukawa et al. ..... 241/267

5,630,555 5/1997 Boyd ..... 241/29

FOREIGN PATENT DOCUMENTS 267338 8/1911 Germany .

189189 11/1922 United Kingdom .

805030 11/1958 United Kingdom .

*Primary Examiner*—John M. Husar

*Attorney, Agent, or Firm*—Armstrong, Westerman, Hattori, McLeland & Naughton

[57] ABSTRACT

A moving point involved in a movable teeth plate of an eccentric jaw crusher rotates on a closed loop, being called hysteresis curve in the specification. The motion of rotation has a top side dead point and a bottom side dead point on one cycle. The normal rotation in the normal direction enables harder materials, concrete, for example to be crushed at high efficiency, the reverse rotation in the reverse direction enabling soft materials, asphalt, for example to be also crushed at high efficiency. One self moving crusher can crush harder and soft materials at the same field where buildings are destroyed, or roads are repaired.

9 Claims, 9 Drawing Sheets

METHOD FOR OPERATING AN ECCENTRIC JAW CRUSHER

FIELD OF THE INVENTION

The present invention relates to a method for operating a jaw crusher and particularly relates to a method for operating a jaw crusher which is operated in a multiple of modes in correspondence to kinds of materials.

BACKGROUND OF THE INVENTION

An eccentric jaw crusher was invented more than one hundred years ago. A V-shaped crushing space is formed between two crushing plates, namely, a fixed plate and a movable plate. The movable plate swings around an eccentric shaft. The crushing space is formed narrower in the lower portion than in the upper portion. Materials are thrown down into the upper portion. A thrown-down material, for example, a piece of stone, is pressed at three points in theory. A selected moving point disposed on the moving plate moves in a closed loop. The closed loop has an upper portion and a lower portion divided by a major axis. The upper portion and a lower portion are not generally symmetric with respect to the major axis. In this specification, a closed loop is called a hysteresis curved line or hysteresis curve.

Both crushing plates press a stone. The differential interval between both crushing plates during crushing the stone is very short. Thereby, a great quantity of energy, which the moving crushing plate has, is instantly transmitted to the stone. Such great energy concentrates locally in the weak portion or inner surface of the stone. Such local concentration allows the stone to be instantly crushed.

An eccentric jaw crusher having such ability of crushing has been applied for crushing hard stones but are recently tried to be utilized for crushing softer materials, for example, asphalt. Self-moving eccentric jaw crushers have been developed by the present inventor. A self moving eccentric jaw crusher is developed for crushing materials which are destroyed at places where buildings are being destroyed or on roads which are being repaired. Such crushed pieces of materials are recycled at the same place as the original materials are crushed.

It is desirable that one eccentric jaw crusher is utilized or operated both for crushing hard materials, concrete for example, and for crushing softer material, asphalt for example. It has been considered that a jaw crusher is not suitable for crushing softer materials, because it has been designed for crushing hard materials.

In fact, softer materials like asphalt are not crushed into a plurality of pieces but, instead, are pressed and destroyed by plastic deformation, especially in summer seasons. As a result, the plasticly deformed material becomes adhesively connected to one plate, thereby it making motion of the other plate impossible. Such occurrence necessitates stopping of the machine and a requirement to rotate the motor in the reverse direction of rotation so as to remove the material adhesively connected to the surface of the crushing plate. After removing the adhesive material, the crushing plate is again rotated in the forward direction.

The present inventor found that reverse rotation of the plate makes it possible to crush effectively softer material. The inventor, who has recognized that the lower portion of the moving crushing plate does not move on a straight line but on a curved line having a hysteresis, though it looks like a straight line, found that such phenomena are theoretically described. Such motion having a hysteresis is mathematically described in U.S. Pat. No. 5,397,069.

SUMMARY OF THE INVENTION

An object of the present invention is to provide a method for operating an eccentric jaw crusher, wherein both hard and softer materials are crushed at the respective high efficiencies of crushing.

A further object of the present invention is to provide a method for operating an eccentric jaw crusher, wherein softer material does not strongly connects to a crushing plate.

A still further object of the present invention is to provide a method for operating an eccentric jaw crusher, wherein suitable modes of crushing are easily obtained by changing operation of the crusher in correspondence to the kinds of materials being crushed.

A still further object of the present invention is to provide a method for operating an eccentric jaw crusher, wherein both abilities of crushing are derived therefrom.

An eccentric jaw crusher according to the present invention has two directions of rotation, in one of which a movable plate normally rotates on a curve having a hysteresis, and in another of which it reversely rotates thereon. That is, an eccentric shaft is rotated normally and reversely. A selected point disposed on in the lower portion of a movable plate moves on a hysteresis curve. Such a hysteresis curve looks like a straight line, but upon close inspection, is found to be formed with an upper portion and a lower portion. The upper portion of the curve is continuously connected at a top dead point and a bottom dead point to the lower portion of the curve. Such a curve looks like a crescent or a prolate ellipsoid.

The curve has a major axis, which intersects with the surface of the other crushing plate. The upper portion and the lower portion of the curve are mutually divided by the major axis. The angle between the major axis and the surface of the other crushing plate is to 30 degrees from 10 degrees. The speed of the moving point is very slow in the regions of the dead points. Particularly, the speed is zero at the dead points and the differential of the velocity is very large.

The movable crushing plate which moves upward on the upper portion of the curve approaches the region of the top dead point toward the other plate with a small angle formed between the surface and the direction of the motion and then approaches at the top dead point toward the other plate with a larger angle formed therebetween. Such motion is called normal rotation and allows hard materials to be effectively crushed.

The moving crushing plate which moves upward on the lower portion of the curve approaches the region of the bottom dead point toward the other plate with a small angle formed between the surface and the direction of the motion and then approaches at the bottom dead point towards the other plate with a larger angle formed therebetween. Such motion is called reverse rotation and allows softer materials to be effectively crushed. Such reverse rotation has ability to remove softer material adhesively connected to the other plate. This ability allows the machine to be continuously operated without stopping the machine and without exchanging one machine (crusher) for another machine (crusher)

It is also advantageous to shift the position at which a toggle plate is swingingly supported. Such shift is able to change the angle between the major axis of the hysteresis curve and the surface of the other crushing plate. The shift enables the hysteresis curve to be varied, the angle of the major axis being varied at the same time. The angle between the vector of velocity of the moving point and the fixed plate can be varied at both dead points. Such variation could make the crushing possibility rich.

A shifting means for shifting the toggle plate is referred to as a selecting means. The selecting means comprises a toggle seat having a multiple of hollows for pivotably supporting the toggle plate, the hollows being located at respective positions which are different from each other. Such hollows may be located on the jaw side toggle seat or the machine body side toggle seat. Such toggle seat is fixed to the machine body, thereby it can have a strong structure.

A BRIEF DESCRIPTION OF THE DRAWINGS FIGURES

FIG. 8 is a front view similar to FIG. 7 in which the toggle plate is moved in.

Figure 10:
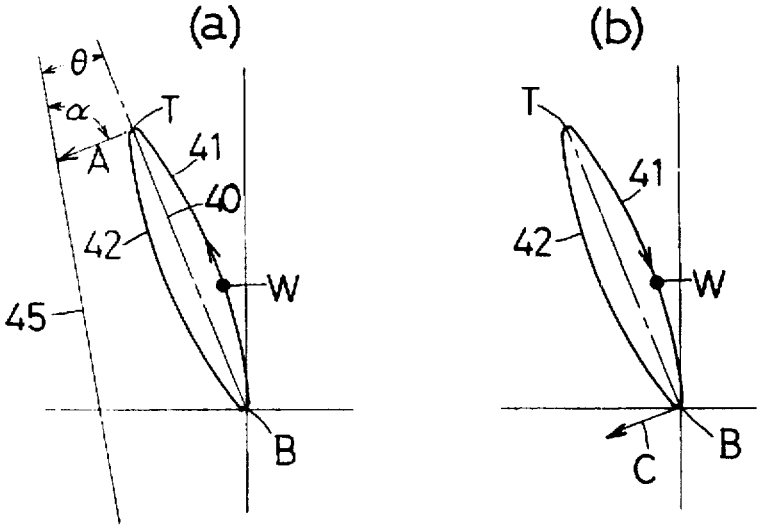

FIGS. 10(*a*) and (*b*) are graphs showing hysteresis curves and directions of rotation.

Figure 11:
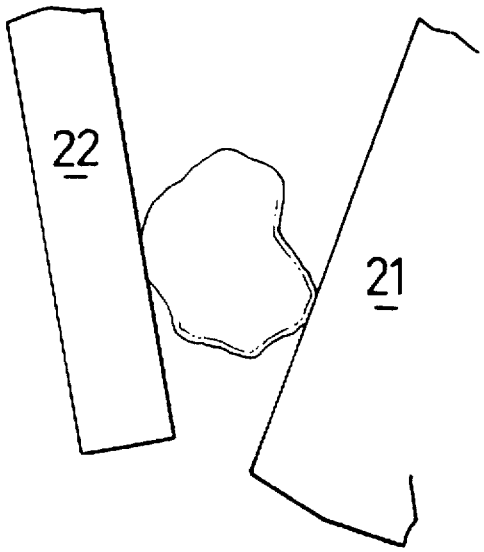

FIG. 11 is a front sectional view showing an aspect of crushing a hard stone.

Figure 12:
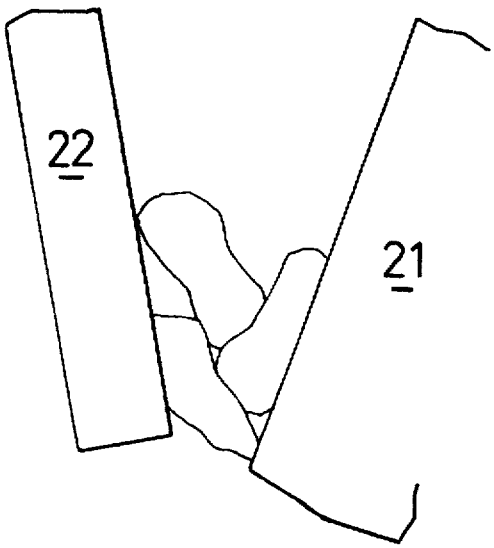

FIG. 12 is a front sectional view showing an aspect of crushing a softer material.

Figure 13:
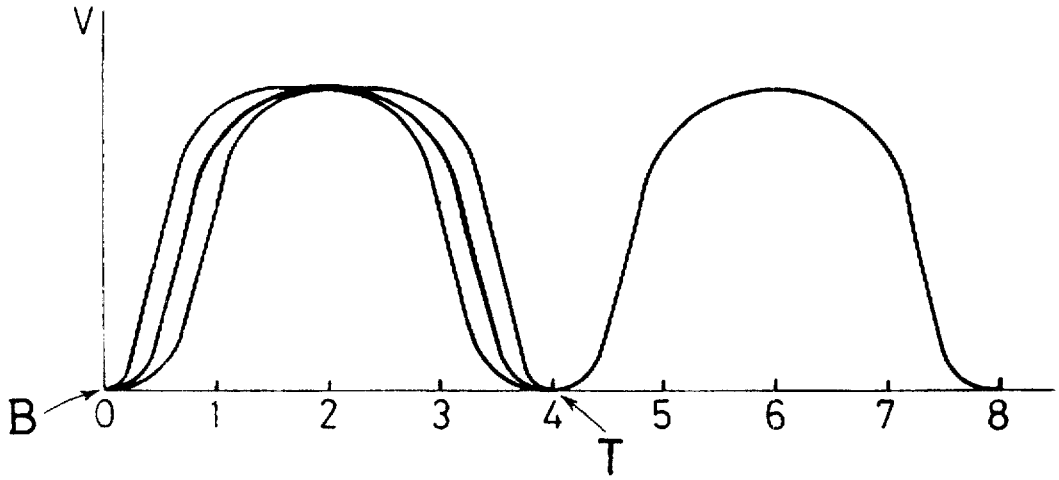

FIG. 13 is a graph showing functions of velocity.

DETAILED DESCRIPTION OF THE PRESENT INVENTION

Figure 1:
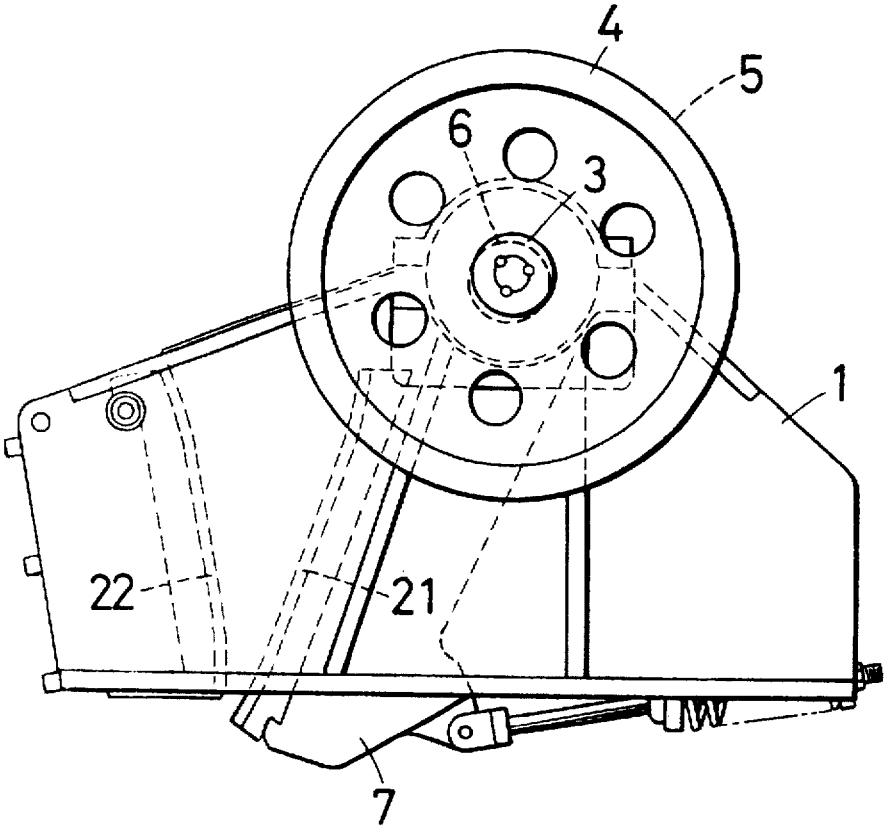
FIG. 1 is a front view of an embodiment of a jaw crusher according to the present invention.
Figure 2:
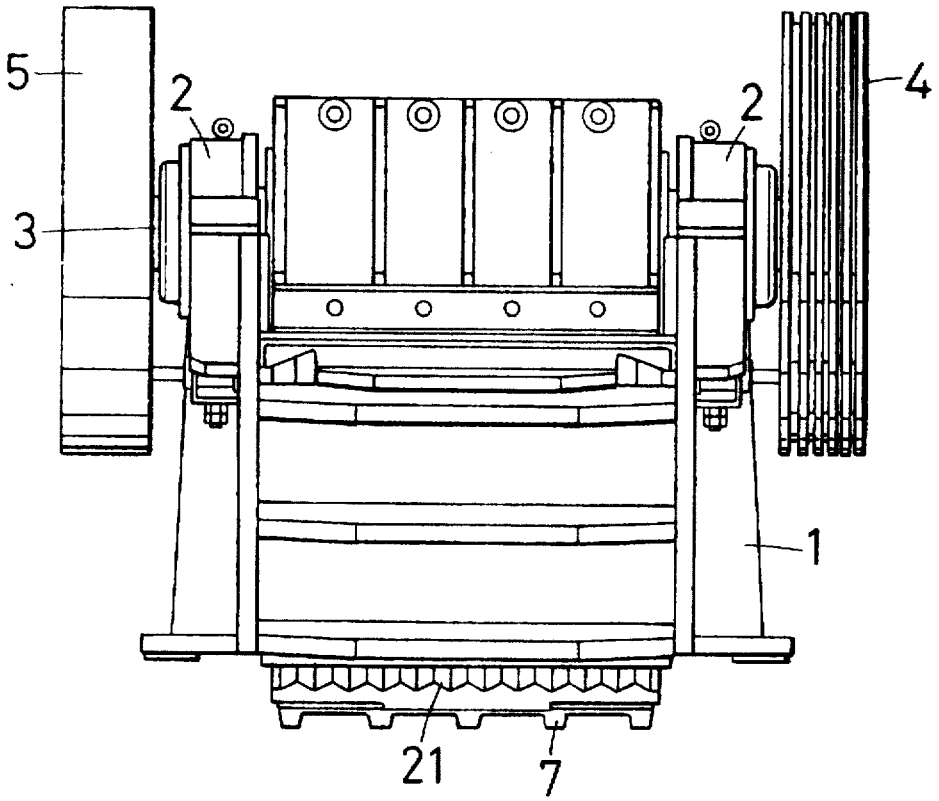
FIG. 2 is a horizontal side view of the jaw crusher of FIG. 1.

An embodiment of an eccentric jaw crusher according to the present invention is described in the following. FIGS. 1 and 2 illustrate an ordinal eccentric jaw crusher for which the present invention is applied. The illustrated jaw crusher is called a single-toggle type of jaw crusher. A machine body 1 of the jaw crusher is rigidly made of steel plates. Two bearings 2 are fixedly mounted on the machine body 1. A rotating driving shaft 3 is rotatably supported by bearings 2. A driving wheel 4 and a flywheel 5 are respectively mounted on both side portions of driving shaft 3.

Driving wheel 4 can accumulate a large quantity of energy for crushing. Driving wheel 4 and flywheel 5 are driven by means of a driving motor (not shown). A hydraulic motor is better applied for the driving motor. The hydraulic motor has a sufficiently large output power, the supply of which is prompt, and has a sufficient ability to absorb a strong impact. Such a hydraulic motor generally has a reverse mechanism, for which a valve is generally equipped.

An eccentric shaft 6 is rotatably mounted on driving shaft 3. There is provided a short distance between the center of driving shaft 3 and the center of eccentric shaft 6. A swinging jaw 7 is pivotably mounted on eccentric shaft 6 and swings around the axis of eccentric shaft 6. The upper potion of swinging jaw 7 is supported by eccentric shaft 6. An eccentrically-rotable-supporting means for supporting eccentrically the upper portion of swinging jaw 7 includes eccentric shaft 6 and machine body 1.

Figure 3:
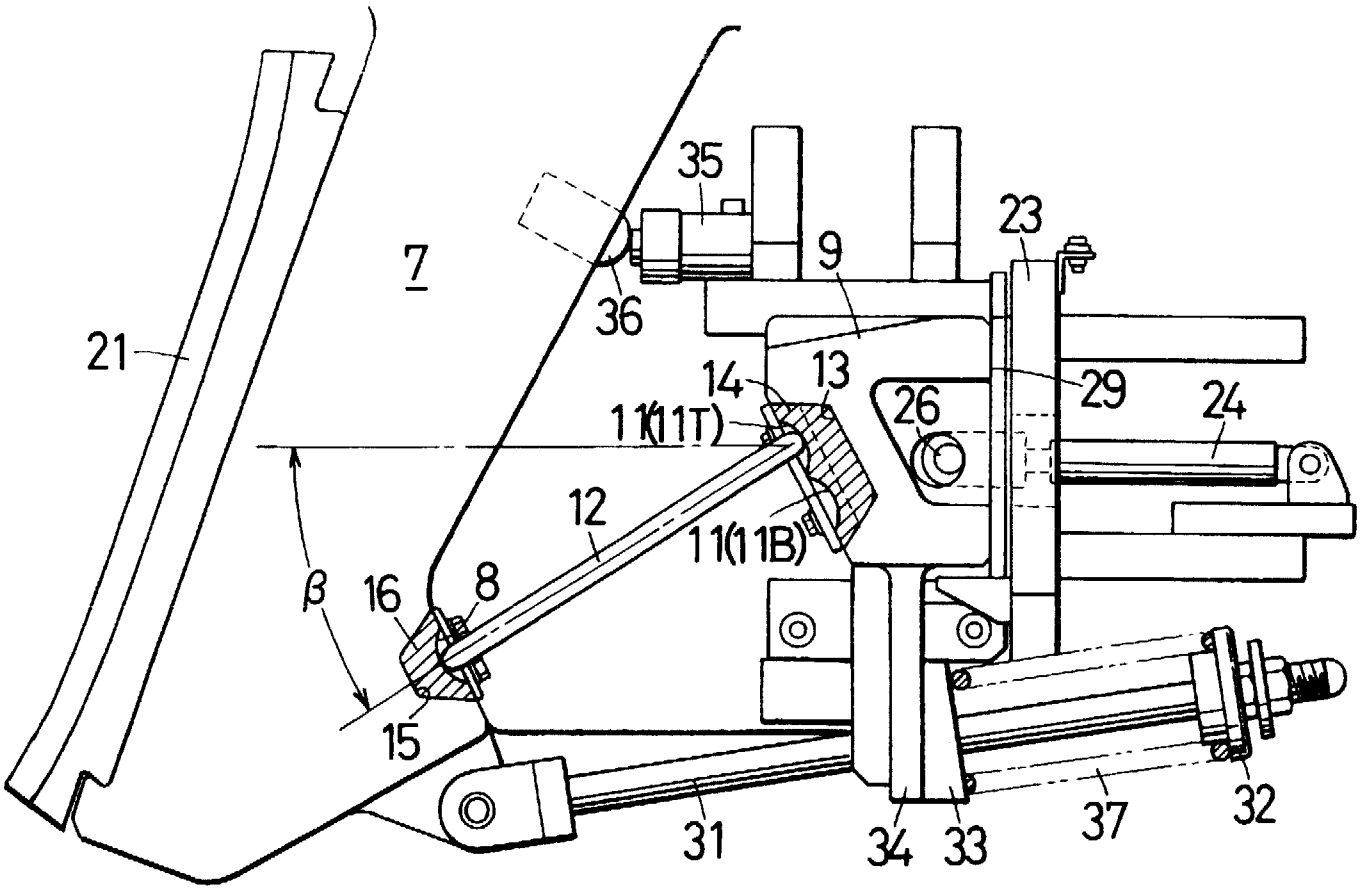
FIG. 3 is a detailed front view of a part of the described jaw crusher

As illustrated in FIG. 3, movable tooth side hollow 8 is situated in the lower right side of swinging jaw 7. Movable tooth side hollow 8 forms a first defined portion or point. A toggle block 9 is mounted on machine body 1. A machine body side hollow 11 is situated on toggle block 9. Machine body side hollow 11 faces in the bevel direction toward movable tooth side hollow 8.

Figure 4:
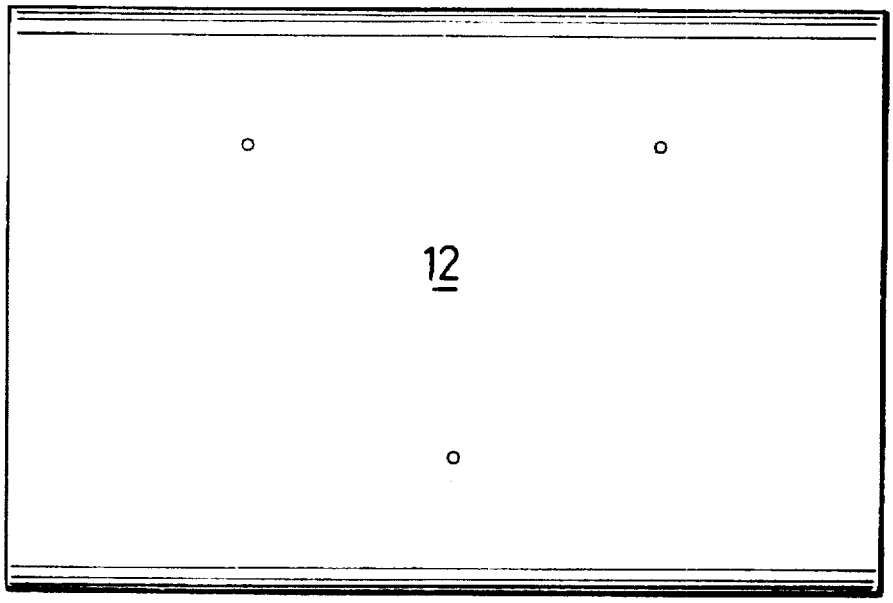
FIG. 4 is a top view of a toggle plate.
Figure 5:
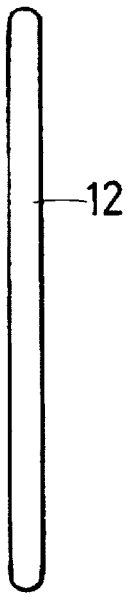
FIG. 5 is a side view of the toggle plate of FIG. 4.

Machine body side hollow 11 forms a second defined portion or point. A toggle plate 12 swingingly lies between movable tooth side hollow 8 of swinging jaw 7 and machine body side hollow 11 of toggle block 9. As illustrated in FIGS. 4 and 5, toggle plate 12 is made of a rectangular metal plate and formed long in the axial direction of driving shaft 3.

Movable tooth side hollow 8, machine body side hollow 11 and toggle plate 12, respectively extends in the axial direction parallel to the axial direction of driving shaft 3. One side portion of toggle plate 12 pivotably connects to movable tooth side hollow 8, while another side portion of toggle plate 12 pivotably connects to machine body side hollow 11. A first receiving hollow 13 is formed on toggle block 9. Receiving hollow 13 receives a machine body side toggle seat 14. Machine body side toggle seat 14 forms a machine body side supporting body for supporting swingingly or pivotably one side portion of toggle plate 12. Machine body side hollow 11 is formed on the front surface of machine body side toggle seat 14.

Machine body side hollow 11 includes an upper machine body side hollow 11T and a lower machine side hollow 11B. Upper machine body side hollow 11T and lower machine side hollow 11B are situated on the bevel plane inclining against a vertical plane. Both hollows 11B, 11T are formed cylindrically.

A second receiving hollow 15 is formed on the rear portion of the lower portion of swinging jaw 7. Second receiving hollow 15 receives a movable tooth side toggle seat 16. Tooth side toggle seat 316 forms a movable tooth side supporting body for supporting swingingly or pivotably another side portion of toggle plate 12. Movable tooth side hollow 8 is formed on the front surface of tooth side toggle seat 16.

The jaw crusher includes two tooth plates. As illustrated in FIG. 1, a movable tooth plate 21 is fixed on the front surface of swinging jaw 7, a fixed tooth plate 22 being fixed on the front portion of machine body 1. The front surface of movable tooth plate 21 faces against the front surface of fixed tooth plate 22. The front surface of movable tooth plate 21 is inclined with respect to the front surface of fixed tooth plate 22. A V-shaped crushing space is formed between both surfaces, the lower portion of the crushing space being narrower than the upper portion thereof. Into the upper portion are deposited materials to be crushed. Movable tooth plate 21 and fixed tooth plate 22 respectively extends in the axial direction and are substantially coextensive there along. Both movable tooth plate 21 and fixed tooth plate 22, respectively, have the teeth, which are respectively formed lattice-like.

Toggle block 9 is securely fixed to a reactive plate 23, which strongly stands on machine body 1. The weight of the swinging jaw 7 acts on toggle block 9 through tooth side toggle seat 16, toggle plate 12 and machine body side toggle seat 14. Toggle block 9, forced as such, is pressed against reactive plate 23. Two bodies of first hydraulic cylinders 24 are mounted on machine body 1, being able to incline. First hydraulic cylinders 24 are able to push toggle block 9 in the forward direction. A pin 26 is fixed on toggle block 9, being positioned in the axial direction between both side portions of toggle block 9. To pin 26 are connected the movable portions of first hydraulic cylinders 24. Toggle block 9 being pushed in the forward direction, a plate-like spacer 29 can be inserted between toggle block 9 and reactive plate 23.

A tension rod 31 is pivotably and swingingly mounted on the lower portion of swinging jaw 7. A compressed coil spring 37 lies between a flange 32 and a spring receiving body 33. Flange 32 is formed as a rear end portion of tension rod 31, while spring-receiving body 33 is fixedly mounted on the lower portion 34 of machine body 1 so that tension rod 31 penetrates coil spring 37.

A second hydraulic cylinder 35 is mounted on the upper portion of machine body 1. Pressure receiving portions 36 are formed on the side portions of swinging jaw 7. Pressure receiving portion 36 receives pressure of second hydraulic cylinders 35. Second hydraulic cylinders 35 can pivotably drive swinging jaw 7 in the clockwise direction in FIG. 3.

Figure 6:
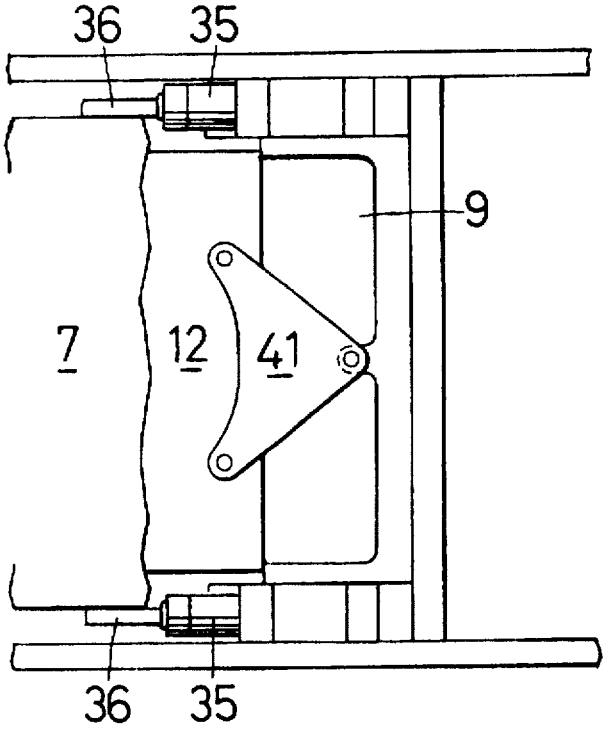
FIG. 6 is a top view of a suspending means employed in the jaw crusher.
Figure 7:
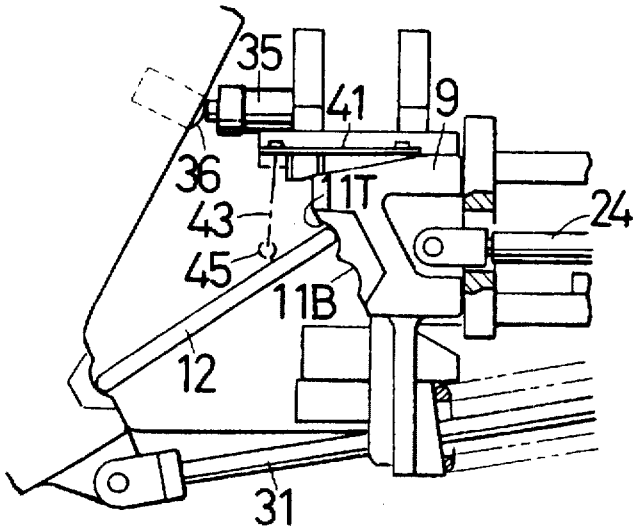
FIG. 7 is a front view of the suspending means shown in FIG. 6.

FIGS. 6 and 7 illustrates a suspending means for varying inclining positions of toggle plate 12. A triangular suspending metal plate 41 is fixed on toggle block 9 by bolts at fixed points. From the two points of suspending metal plate 41 are suspended two suspension bolts 43. Eye-bolts 45 are fixed on toggle plate 12 at two points. Into eye-bolts 45 are respectively inserted the respective hooks of suspension bolts 43.

Figure 8:
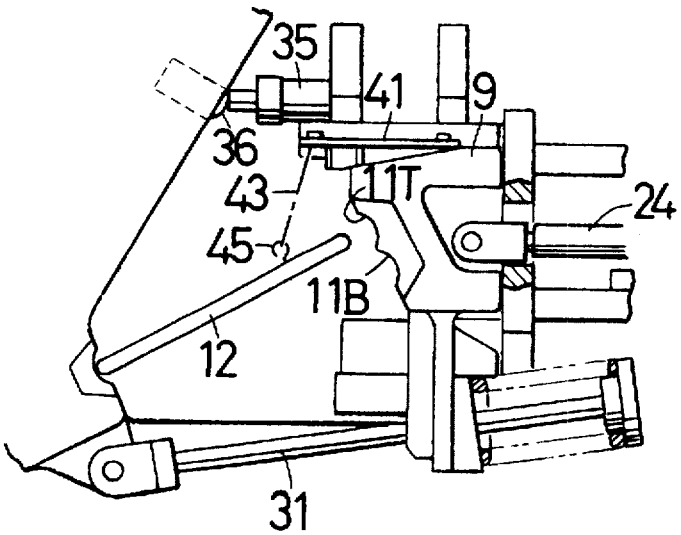

As illustrated in FIG. 8, swinging jaw 7 is pivotably driven by second hydraulic cylinder 35 in the clockwise direction, toggle plate 12 being suspended by suspension bolts 43. The machine body side portion of toggle plate 12 is moved downward by screwing suspension bolts 43. The pressure of second hydraulic cylinder 35 being reduced permits swinging jaw 7 to pivot in the anticlockwise direction, whereby the machine body side portion of toggle plate 12 is received into lower machine side hollow 11B. As such, the heavy toggle plate 12 is easily moved.

Rotating driving shaft 3 being driven, eccentric shaft 6 rotates around rotating driving shaft 3. Swinging jaw 7 swinging around upper machine body side hollow 11T, a selected point in the region of movable tooth side hollow 8 moves in general on a circular arc.

A stone of large size is inserted between movable tooth plate 21 and fixed tooth plate 22 into the upper portion of the crushing space V. It is inserted and then pressed at three points in principle, as illustrated in FIG. 11 (only two points appear.), thereby the stress concentrates on the three points. The crushable article inserted between movable tooth plate 21 and fixed tooth plate 22 is forced in the directions perpendicular to the surface of movable tooth plate 21 and the surface of fixed tooth plate 22. The stress generated by such pressing distributes in the three dimensions to be an inner stress in the article. The crushable article inserted between movable tooth plate 21 and fixed tooth plate 22 is forced also in the direction parallel to the surface of movable tooth plate 21 and the surface of fixed tooth plate 22. The intensity of the inner stress instantly generates two stressed clusters inside the article, thereby the article is divided into two pieces. Such divided articles of smaller size fall into the middle portion of the crushing space V. The articles in the middle space are divided in the same manner as described above to be of still further smaller size.

Figure 9:
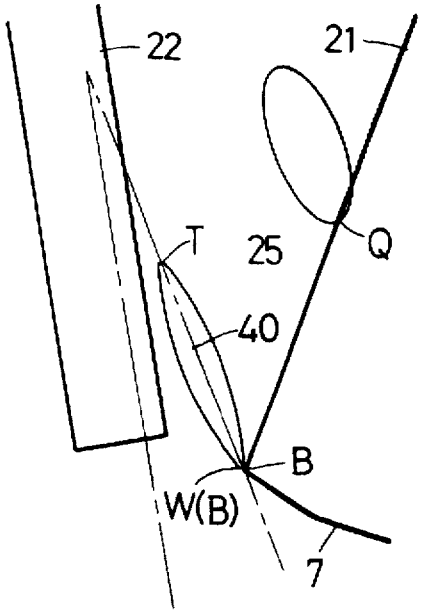
FIG. 9 is a sectional front view of crushing plates.

As illustrated in FIG. 9, the moving point W of the lower end portion of movable tooth plate 21, which is fixed to swinging jaw 7, moves on a prolate ellipsoid-like hysteresis curve, approximately moving on a straight line inclining against the surface of fixed tooth plate 22. Another moving point Q of the upper portion moves on a more elliptic curve.

Major axis 40 is defined as a straight line linking the dead top point T to the dead bottom point B. FIG. 13 shows functions of velocity. In FIG. 13, the horizontal axis shows the distance of movement of the moving point W, the vertical axis showing the velocity of the moving point W. The graduation of the horizontal axis divides one cycle of the hysteresis-curve into 8 portions. The velocity is commonly zero or almost zero in value at the dead points. A selected point in the region of the lower end point W moves on a hysteresis curve which is almost the same in size and in shape as the curve on which the moving point W moves.

The curve is generally seen as sharp, but is locally observed to be smooth. The differential function of velocity is continuous, having no singular point at which the velocity is constant.

The parameters defining such shape of the curve are as follows: eccentricity (the distance between the center of eccentric shaft 6 and the center of driving shaft 3), the distance between the center of eccentric shaft 6 and upper machine body side hollow 11T or lower machine body side hollow 11B, the distance between the center of eccentric shaft 6 and the moving point W, the length (width) of toggle plate 12, and the angles defined by the three points of the above centers and point. Some of the parameters depend on the angle β (shown in FIG. 3) between toggle plate 12 and a reference surface, for example, a horizontal plane, and the distance of the center of eccentric shaft 6 and the center of movable tooth side hollow 8, particularly depending on the angle β

The angle α between the direction of the velocity of the moving point W at the dead point and the surface of the plate 22 is a function of the angle β. As shown in FIG. 10, the angle β between the direction of the vector A and the surface 45 of fixed tooth plate 22 is approximately 80 degrees, being smaller than an angle θ. The vector A at the top side dead point is almost the same as the vector C at the bottom side dead point. Both vectors are slightly different from each other.

The value of the velocity is very small at the bottom dead point B and the top dead point T, but it becomes the maximum values in the intermediate portion between the bottom dead point B and the top dead point T. The moving point W is quickly accelerated to have a large velocity. The direction in which the moving point W on the top dead point moves toward the bottom dead point is shown by the arrow A as shown in FIG. 10(*a*). Rotation in such direction is called normal rotation in this specification.

Stones are harder than materials such as asphalt. In this specification, four words are used for four materials, those are, harder stones, soft stones, harder lumps of asphalt, soft lumps of asphalt.

One angle β in the case that one end of toggle plate 12 is positioned at upper machine body side hollow 11T is different from another angle β in the case that the end of toggle plate 12 is positioned at lower machine body side hollow 11B. The angle α is a function of the angle β.

It is supported by the inventor's experiments that a larger angle β is apt to be suitable for crushing harder stones, a small angle β being apt to be suitable for crushing soft stones. Some stones do not follow such inclination. An operator may select the angle β with reference to the kind of material.

The suspending means, as shown in FIG. 6 and 7, is available for selecting the angle β. Toggle plate 12 is too heavy to be lifted up by an operator without any danger. The suspending means makes it easy and safe to change the angle β. Machine body side toggle seat 14 is directly fixed to and supported by machine body 1. In other words, machine body side toggle seat 14 is not fixed to machine body through any resilient material, thereby the structure for supporting toggle plate 12 is strongly formed. Spacer 29 is made of strong material equivalent to that of the machine body. Spacer 29 is not supported by first hydraulic cylinder 24 but by machine body 1, thereby spacer 29 is conceived as a part of machine body 1 in respect to the supporting means.

As illustrated in FIG. 10(*a*) and (*b*), the curve is divided into two portions by major axis 40. In the motion shown in FIG. 10 (*a*), the point W moves upward on the upper portion of the hysteresis curve. That is, the point W is on the upper portion 41 of the hysteresis curve, moving upward in the direction to the top dead point T from the bottom dead point B. On the other hand, the point W moves downward on the lower portion of the hysteresis curve. That is, the point W is on the lower portion 42 of the hysteresis curve, moving downward in the direction to the bottom dead point B from the top dead point T.

In the motion shown in FIG. 10(*b*), the point W moves downward on the upper portion 41 of the hysteresis curve. That is, the point W is on the upper portion 41 of the hysteresis-curve, moving downward in the direction to the bottom dead point B from the top dead point T. On the other hand, the point W moves upward on the lower portion 42 of the hysteresis curve. That is, the point W is on the lower portion 42 of the hysteresis curve, moving upward in the direction to the top dead point T from the bottom dead point B.

Fixed tooth plate 22, which is a set of the points respectively moving on the respective ellipsoid-like hysteresis curve, functions in general as mentioned above. It is significant in a crusher according to the present invention to analyze the nature in the differentiation as to the motion. As shown in FIG. 10(*a*), a conventional crusher is operated so that the point W rotates in the anti-clockwise direction. Such a conventional direction of rotation is reasonable as described below.

The major axis 40, appearing in FIG. 10(*a*), against the surface 45 is inclined at angle θ so at the crushed stone crushed at the dead point T is pushed into the lower portion of the space V. In such region, the displacement of the moving point is very small. During this motion of the very small displacement, the whole energy of the flywheel is instantly transmitted to the stone to be crushed. Such transmitted energy is called impact energy.

After the initial crushing, that is, after the moving point W passing the top side dead point, movable tooth plate 21 approaches the fixed tooth plate 22, continuously giving energy to the stone so that the is divided into two clusters. From such principle of crushing, it has been thought that a jaw crusher is not suitable for crushing softer materials but only for crushing hard materials. For softer materials that are not pressed at points but pressed between surfaces, as shown FIG. 12, are plasticly destroyed.

The inventor noticed that a method for crushing in the direction of rotation as shown in FIG. 10(*b*) is, nevertheless, reasonable for crushing softer materials, asphalt for example. The moving point W, as shown in FIG. 10(*b*), approaches against fixed tooth plate 22 at the bottom side dead point with the angle α given. The crushing mechanism is same at the top side dead point as at the bottom dead point in the respect that crushing effects are produced when the moving point approaches to fixed tooth plate 22. Soft materials are initially crushed at the bottom dead point. Initially crushed materials are completely crushed. In other words, initially crushed materials are easily divided by a peeling force. Such peeling force is brought out during the course the moving point W moves upwards on the lower curve portion 42, the space between the movable tooth plate 21 and fixed tooth plate 22 being narrower.

However, the initially crushed materials pushed up into the wider portion of the space V. They are not still pressed but merely peeled themselves by the above mentioned peeling force, thereby they are not formed plastic and do not adhere to the tooth plates 21,22.

What is claimed is:

1. A method for operating an eccentric jaw crusher having a fixed crushing plate and a movable crushing plate in which a selected point on said movable crushing plate moves with respect to said fixed crushing plate, comprising the steps of:

moving said movable crushing plate with respect to said fixed crushing plate along a path defined by a closed hysteresis curve having a top dead point and a bottom dead point and which is inclined with respect to a facing surface of said fixed crushing plate, and selectively moving said movable plate to traverse said hysteresis curve in a first direction for crushing a first material or in a reverse direction for crushing a second material.

2. A method for operating an eccentric jaw crusher of claim 1, in which said movements of said movable crushing plate include movement in a normal direction, wherein said selected point on said movable crushing plate moves towards said fixed crushing plate at the top dead point of said hysteresis curve for crushing said first material, and movement in a reverse direction, wherein said selected point on said movable crushing plate moves towards said fixed crushing plate at said bottom dead point of said hysteresis second material.

3. A method for operating a jaw crusher of claim 1, including the steps of:

moving said selected point upwards towards said top dead point on an upper portion of said closed hysteresis curve for crushing said first material, and moving said selected point upwards towards said top dead point on a lower portion of said closed hysteresis curve for crushing said second material.

4. A method for operating a jaw crusher of claim 1 including the steps of:

moving said selected point upwards on said upper portion of said hysteresis curve towards said top dead point during crushing of hard material, moving said selected point upwards on said lower portion of said hysteresis curve towards said top dead point during crushing of softer material.

5. A method for operating an eccentric jaw crusher of claim 1, including the steps of:

varying the inclination of said closed hysteresis curved line.

6. A method for operating a jaw crusher including a machine body mounting a fixed crushing plate and a movable crushing plate supported by supporting means to be eccentrically driven with respect to said fixed crushing plate whereby a selected point on said movable crushing plate moves along a path defining a closed hysteresis path formed by an upper curve portion and a lower curve portion, the opposite ends of which are closed by an upper dead point and a lower dead point, respectively, and a flywheel giving force to said movable crushing plate, said method comprising the steps of:

moving said movable crushing plate in a normal direction wherein said selected point moves along said upper portion of said hysteresis path and nearer to said fixed crushing plate at said top dead point for crushing hard material, and moving said movable crushing plate in a reverse direction wherein said selected point moves away from said fixed crushing plate at said top dead point along a lower portion of said hysteresis path and for crushing softer material.

7. A method for operating an eccentric jaw crusher of claim 6, wherein said closed hysteresis curve includes an upper portion and a lower portion, and including the steps of:

moving said selected point on said movable crushing plate upwards on said upper portion of said hysteresis curve towards said upper dead point during crushing of said hard material, and moving said selected point on said movable crushing plate upwards on said lower portion of said hysteresis curve towards said upper dead point during crushing of said softer material.

8. A method for operating an eccentric jaw crusher of claim 7 having a hydraulic valve for changing the direction of movement of said movable plate comprising the steps of:

changing the direction of movement of said movable plate from a normal direction to a reverse direction by operating said hydraulic valve.

9. A method for operating an eccentric jaw crusher, having a fixed crushing plate and a movable crushing plate, wherein a selected moving point on said movable crushing plate moves on a closed hysteresis curved line having a top side dead point and a bottom side dead point, comprising the steps of:

reversing the directions in which said selected moving point moves, and varying said closed hysteresis curved line in response to the hardness of the material to be crushed.

* * * * *